US008959932B2

(12) United States Patent
Matsubara

(10) Patent No.: US 8,959,932 B2
(45) Date of Patent: Feb. 24, 2015

(54) CRYOPUMP AND EVACUATION METHOD

(75) Inventor: Takahiro Matsubara, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 1346 days.

(21) Appl. No.: 12/285,975

(22) Filed: Oct. 17, 2008

(65) Prior Publication Data

US 2009/0165469 A1 Jul. 2, 2009

(30) Foreign Application Priority Data

Dec. 28, 2007 (JP) ..... 2007-340000

(51) Int. Cl.
*B01D 8/00* (2006.01)
*F04B 37/08* (2006.01)

(52) U.S. Cl.
CPC ..... *F04B 37/08* (2013.01)
USPC ..... 62/55.5; 62/268; 417/44.1

(58) Field of Classification Search
USPC ..... 62/55.5, 268; 417/44.1, 907; 55/DIG. 15
See application file for complete search history.

(56) References Cited

U.S. PATENT DOCUMENTS

2005/0155358 A1* 7/2005 Ash et al. ..... 62/55.5
2006/0064990 A1* 3/2006 Bartlett et al. ..... 62/55.5

FOREIGN PATENT DOCUMENTS

JP 02-308985 A 12/1990
JP 08121337 A * 5/1996 ..... F04B 37/08
JP 08-219019 A 8/1996
JP 10-131858 A 5/1998
TW 200610895 4/2006

OTHER PUBLICATIONS

KR Office Action, App No. 10-2008-0130891, Nov. 19, 2010 (5 pages).
Office Action issued in corresponding Taiwanese application No. 097142356. dated Mar. 12, 2012.

* cited by examiner

*Primary Examiner* — Frantz Jules
*Assistant Examiner* — Azim Abdur Rahim
(74) *Attorney, Agent, or Firm* — Rader, Fishman & Grauer PLLC

(57) ABSTRACT

A cryopump includes: a cryopump chamber having an inlet port through which a gas to be pumped is introduced; a refrigerator provided with a second cooling stage provided in the cryopump chamber; an intermediate member thermally coupled to the second cooling stage; and a cryopanel having a connecting part connected to the intermediate member at a position farther from the inlet port in the direction in which the gas is introduced than the second cooling stage, and extending from the connecting part toward the inlet port. For example, a cryopump having a suspended panel structure is provided.

9 Claims, 6 Drawing Sheets

CRYOPUMP AND EVACUATION METHOD

BACKGROUND OF THE INVENTION

1. Field of the Invention

The present invention relates to a cryopump and an evacuation method.

2. Description of the Related Art

A cryopump is a vacuum pump that captures and pumps gas molecules by condensing or adsorbing molecules on a cryopanel cooled to an extremely low temperature. A cryopanel is generally used to achieve a clean vacuum environment required in a semiconductor circuit manufacturing process.

For example, cited document 1 describes a cryopump provided with a plurality of elongated panels mounted in a radial pattern on the back of a heat shield panel with respect to the direction in which the gas is introduced and extending backward from the heat shield panel. [patent document No, 1] JP 2-308985

In the aforementioned cryopump, a heat shield panel is provided close to and opposite to the opening through which the gas to be pumped is introduced. The heat shield panel restricts the flow of gas to the cryopanels below so that the pumping speed of the cryopump is lowered accordingly. Since the heat shield panel with a relatively large area that occupies the major part of the cross section of the cryopump is provided close to the opening of the cryopump, a large amount of radiant heat is input from outside. For this reason, energy consumption required to cool the cryopanels sufficiently will be increased. Further, the temperature of the cryopanels may be increased and the pumping performance may be adversely affected.

SUMMARY OF THE INVENTION

In this background, a general purpose of the present invention is to provide a cryopump that achieves high pumping performance while controlling the effects from radiant heat.

One embodiment of the present invention relates to a cryopump. The cryopump comprises: a cryopump chamber having an inlet port through which a gas to be pumped is introduced; a refrigerator provided with a cooling stage provided in the cryopump chamber; an intermediate member thermally coupled to the cooling stage; and a cryopanel having a connecting part connected to the intermediate member at a position farther from the inlet port in the direction in which the gas is introduced than the cooling stage, and extending from the connecting part toward the inlet port.

According to this embodiment, each of the cryopanels extends toward the inlet port and connected to the cooling stage of the refrigerator at a position away from the inlet port. Therefore, it is ensured that the flow of gas molecules introduced through the inlet port arrive at the surface of the cryopanels efficiently. As a result, high pumping speed is achieved. Further, the cryopanel is connected to the intermediate member for thermal coupling to the cooling stage at a position away from the inlet port. In this way, radiant heat transferred from outside the inlet port to the intermediate member is reduced. Accordingly, it is ensured that the cryopump is less affected by radiant heat from outside.

Another embodiment of the present invention relates to a cryopump. The cryopump comprises: a refrigerator; a heat shield having an opening through which a gas to be pumped is introduced; and a cryopanel having a connecting part thermally coupled to the refrigerator at a position farther from the opening than the center of the heat shield, and extending from the connecting part toward the opening.

According to this embodiment, the cryopanel extends toward the opening of the heat shield and connected to the refrigerator at a position away from the opening. Therefore, it is ensured that the flow of gas molecules introduced from outside arrive at the surface of the cryopanel efficiently so that high pumping speed is achieved. Since the cryopanel is connected to the refrigerator at a position away from the opening, radiant heat transferred to the cryopanel via the connecting part is reduced accordingly.

Still another embodiment of the present invention relates to a cryopump. The cryopump comprises: a cryopanel arranged in a predetermined layout inside a cryopump; and a panel mounting member having a panel mounting surface on which the cryopanel is mounted and supporting the cryopanel in the layout. The panel mounting member may be provided such that the geometric factor occurring when an external heat source is viewed from the panel mounting surface is minimized.

Yet another embodiment of the present invention relates to an evacuation method. In this method, there is used a cryopump provided with a refrigerator, a heat shield having an opening through which a gas to be pumped is introduced, and a cryopanel surrounded by the heat shield and thermally coupled to the refrigerator. The method comprises: thermally coupling the cryopanel, which extends beyond the center of the thermal shield, to the refrigerator at a position farther from the opening than the center of the heat shield; cooling the cryopanel by driving the refrigerator; and capturing gas molecules at least in an end part of the cryopanel closer to the opening than the center of the heat shield.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
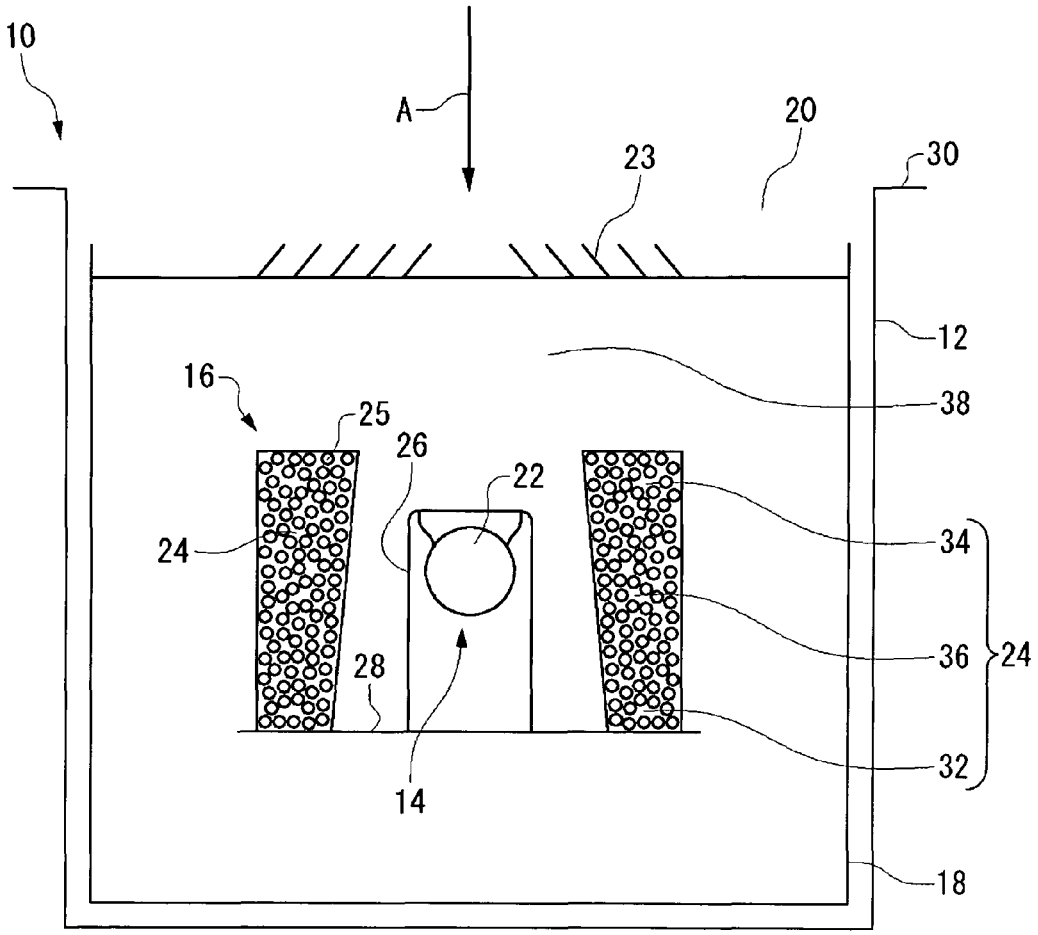
FIG. 1 schematically shows a part of a cryopump according to a first embodiment of the present invention.

The invention will now be described by reference to the preferred embodiments. This does not intend to limit the scope of the present invention, but to exemplify the invention.

A description will first be given of a summary of embodiments of the present invention. In one embodiment, there is provided a cryopump having a suspended cryopanel with a low barycentric position. For example, the barycentric position of the cryopanel is provided lower than the cooling stage of a refrigerator. Alternatively, the barycentric position of the cryopanel may be provided lower than the center of the interior space of the cryopump chamber or a heat shield. For the purpose of providing the cryopanel in the lower part of the cryopump chamber, a panel mounting member or an intermediate member extending downward in the cryopump chamber from the cooling stage may be provided to mechanically support the cryopanel and thermally couple the panel to the refrigerator. The panel mounting member suspends the cryopanel from the cooling stage.

In this specification, the neighborhood of the inlet port in the interior of the cryopump will be referred to using such terms as "upper" or "above", and the opposite, deeper part of the interior of the cryopump will be referred to using such terms as "lower" or "below". Similarly, the direction extending from the interior of the cryopump toward the inlet port will be referred to using a term "upward". Conversely, the direction extending from the inlet port toward the interior of the cryopump will be referred to using a term "downward".

The cryopump may be provided with a first cryopanel cooled to a first cooling temperature level and a second cryopanel cooled to a second cooling temperature level lower than the first cooling temperature level. The first cryopanel condenses and captures a gas having a vapor pressure lower than an ambient pressure at the first cooling temperature level so as to pump the gas accordingly. For example, the first cryopanel pumps a gas having a vapor pressure lower than a reference vapor pressure (e.g., $10^{-8}$ Pa). The second cryopanel condenses and captures a gas having a vapor pressure lower than an ambient pressure at the second cooling temperature level so as to pump the gas accordingly. In order to capture a non-condensable gas that cannot be condensed at the second temperature level due to a high vapor pressure, an adsorption area is formed on the surface of the second cryopanel. An adsorption area is formed by, for example, providing an adsorbent on the panel surface. A non-condensable gas is adsorbed by the adsorption area cooled to the second temperature level and pumped accordingly.

In case a condensable gas is condensed and covers the adsorption area, contact of a non-condensable gas with the adsorption area is prevented. This will reduce the performance of adsorbing a non-condensable gas and consequently reduces the performance of pumping the non-condensable gas. For example, the gas pumping speed is reduced and the amount of occluded gas is reduced. In order to maintain the performance of pumping a non-condensable gas, it is preferable to ensure that the condensable gas is not likely to reach the adsorption area by arranging the adsorption area so as not be exposed to the inlet port. In this respect, it is preferable that the adsorption area be shielded from the inlet port by means of, for example, the first cryopanel, a portion of the second cryopanel other than the adsorption area, or a connecting member connecting the cryopanel with the refrigerator. Shielding the adsorption area from the inlet port also ensures that the adsorption performance is less affected by radiant heat transferred from outside.

However, condensation of a condensable gas on an adsorption area does not present a problem depending on the application of a cryopump. One such application of a cryopump is an ion implantation apparatus. In this application, the amount of gas condensed by the second cryopanel is small and the main purpose of the cryopanel is to pump a non-condensable gas (e.g., hydrogen). Therefore, it is preferable to ensure that the non-condensable gas can easily reach the adsorption area by exposing the adsorption area to the inlet port. With this, a high pumping speed can be achieved.

If the cryopanel is merely exposed to the inlet port, however, pumping will be affected by radiant heat from an external heat source. Of particular note, since the second cryopanel is cooled to an extremely low temperature of, for example, 10-20 K, radiant heat affects pumping significantly even if the temperature outside the cryopanel is room temperature. Particularly, emissivity (i.e., absorptivity) on the panel surface is increased if the adsorbent (e.g., activate charcoal) is pasted onto the exposed cryopanel surface, with the result that pumping is more likely to be affected by radiant heat. As a result of thermal input from radiation, gas molecules once adsorbed may be evaporated again. In another aspect, a refrigerator having a high refrigerating capacity will be necessary to cool the second cryopanel to a necessary temperature level and maintain it at the level against the thermal input from radiation, or the refrigerator will consume a large energy.

To address this, the cryopanel according to one embodiment of the present invention is provided with suspended cryopanels. With this, it is ensured that the cryopanels are exposed to the inlet port and at the same time a great distance from the inlet port is secured by providing the cryopanels in the deeper part of the interior of the cryopump. This ensures that the exposed adsorption area is less affected by radiant heat and high performance of pumping a non-condensable gas is achieved.

Improvement in the pumping speed resulting from the exposure of the cryopanel leads to reduction of the adsorption area required to achieve a required pumping speed. The reduction is possible due to the fact that exposure of the panel facilitates the flow of gas and increases the pumping speed per unit area of the adsorption area. In other words, less adsorption area is required to achieve the required pumping speed. As a result, the required panel area is also reduced. In association with this, the weight of the cryopanel structure is also reduced.

Reduction of the panel weight will reduce the time required for regeneration of the cryopanel. A cryopump is a "trapping" vacuum pump. As such, regeneration for releasing a gas trapped inside at an appropriate frequency is performed. Regeneration is a process whereby the temperature of a cryopanel is raised higher (e.g., room temperature) than the operating temperature so that the gas condensed or adsorbed on the panel surface is evaporated again and discharged outside. The cryopanel is cooled again to the operating temperature. One of the major factors that determine regeneration time is the time required for re-cooling. The time required for re-cooling is correlated with the weight of the panel structure. According to the embodiment, the weight of the panel structure is reduced so that the time required for re-cooling is reduced and the regeneration time is reduced accordingly.

The cryopump according to one specific embodiment that complies with the above-mentioned design concept is provided with a cryopump chamber, a refrigerator, an intermediate member, and a cryopanel. The cryopanel chamber is provided with an inlet port through which the gas to be pumped is introduced. The refrigerator is provided with a cooling stage which is provided in the interior of the cryopump chamber. The intermediate member thermally couples the cryopanel with the cooling stage. The cryopanel has a connecting part provided below the cooling stage and connected with the intermediate member. The cryopanel extends upward from the connecting part.

The cryopanel according to another specific embodiment is provided with a refrigerator and a cryopanel. The cryopanel has a connecting part provided below the center of the interior of the cryopump and thermally coupling the panel to the refrigerator. The cryopanel extends upward from the connecting part.

The cryopanel according to still another specific embodiment is provided with a cryopanel and a panel mounting member. The cryopanel is arranged in a predetermined layout in the interior of the cryopump. The panel mounting member is provided with a panel mounting surface on which the cryopanel is mounted and supports the cryopanel in the predetermined layout. The panel mounting member is arranged such that the geometric factor occurring when an external heat source is viewed from the panel mounting surface is substantially minimized. The panel mounting surface may be a plane opposite to the opening of the cryopump. In this case, the position of the panel mounting surface in the normal direction may be determined such that the geometric factor occurring when a heat source is viewed from the panel mounting surface is substantially minimized.

A cryogenic surface for capturing gas by condensation or adsorption and pumping the gas accordingly is formed on the surface of the cryopanel. An adsorbent for adsorbing gas is provided at least in a portion of the surface of the cryopanel so as to form an adsorption area. At least a portion of the adsorption area is exposed to the opening of the cryopump. For example, activated charcoal may be used as the adsorbent. Activated charcoal particles may be attached on the entirety of both surfaces of the cryopanel so that the entirety of the surface of the panel represents an adsorption area.

Figure 2:
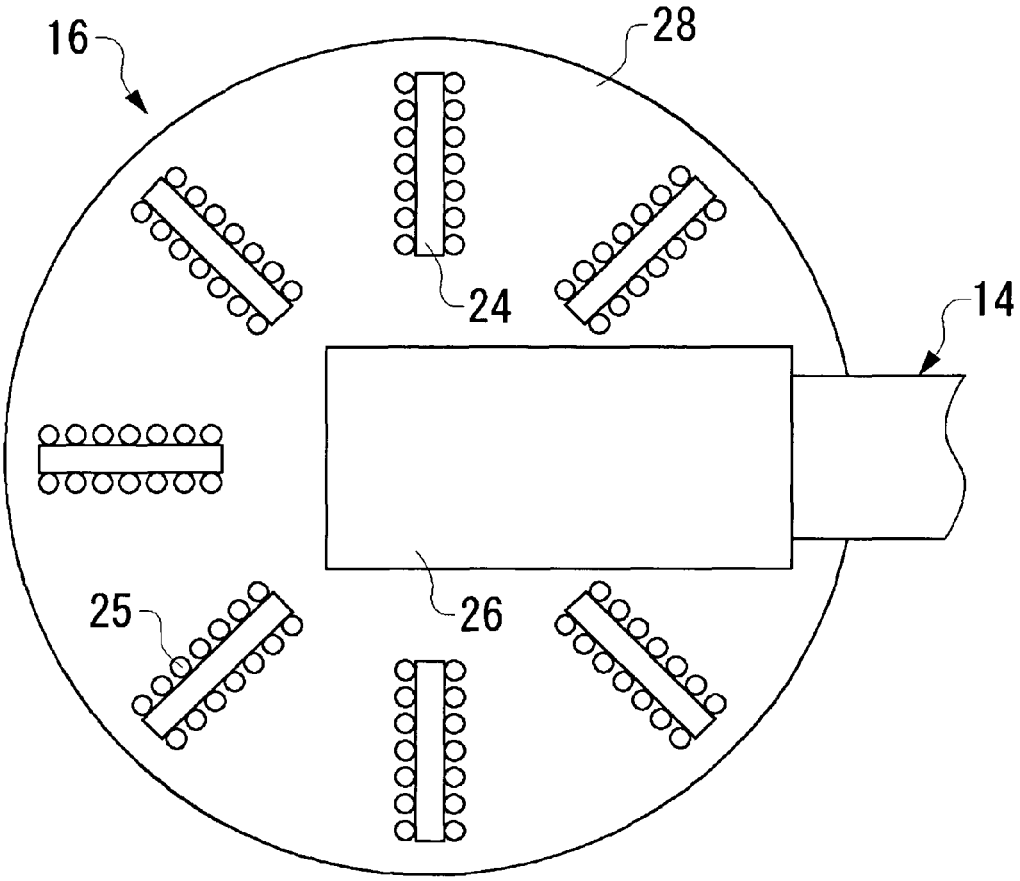
FIG. 2 schematically shows a part of the cryopump according to the first embodiment of the present invention.

FIGS. 1 and 2 schematically show a part of a cryopump 10 according to a first embodiment of the present invention. The cryopump 10 is mounted in a vacuum chamber of an apparatus, such as an ion implantation apparatus and a sputtering apparatus, that requires a high vacuum environment. The cryopump 10 is used to enhance the degree of vacuum in the vacuum chamber to a level required in a requested process. For example, the cryopump 10 achieves a high degree of vacuum of about $10^{-5}$ Pa or about $10^{-8}$ Pa.

The cryopump 10 comprises a pump chamber 12, a refrigerator 14, a panel structure 16, and a heat shield 18. The cryopump 10 shown in FIG. 1 is of horizontal type. Generally, a cryopump of horizontal type is configured such that a second cooling stage 22 of the refrigerator 14 is introduced into the heat shield 18 in a direction (normally, the perpendicular direction) intersecting the axial direction of the cylindrical heat shield 18.

The invention is equally applicable to a cryopump of vertical type. A cryopump of vertical type is configured such that the refrigerator 14 is introduced in the axial direction of the heat shield 18.

FIG. 1 schematically shows a cross section exposing a plane that contains the central axis of the pump chamber 12 and the heat shield 18 and is perpendicular to the central axis of the refrigerator 14. FIG. 1 indicates the direction in which the gas is introduced from the vacuum chamber into the interior of the cryopump by an arrow A. FIG. 2 schematically shows the panel structure 16 viewed in the direction A in which the gas is introduced.

The direction A in which the gas is introduced should be understood as a direction extending into the cryopump from outside. FIG. 2 illustrates the direction A as being parallel with the axial direction of the cryopump 10 merely for ease of understanding. The actual direction in which gas molecules are introduced into the interior of the cryopump in a cryopumping process does not strictly match the illustrated direction A. Rather, the gas is ordinarily introduced in a direction intersecting the direction A.

The pump chamber 12 is provided with a cylindrically formed portion having an opening 20 at one end and having the other end closed. The panel structure 16 and the heat shield 18 are provided inside the pump chamber 12. The opening 20 is provided as an inlet port through which the gas to be pumped is introduced. The opening 20 is defined by the interior surface of the upper end of the cylindrical lateral surface of the pump chamber 12. A mounting flange 30 radially extends outside from the upper end of the pump chamber 12. The cryopump 10 is mounted in the vacuum chamber of, for example, an ion implantation apparatus the volume of which is subject to pumping, by means of the mounting flange 30. The cross section of the pump chamber 12 is not limited to circular but may be elliptical or polygonal.

For example, the refrigerator 14 is a Gifford-McMahon refrigerator (so-called a GM refrigerator). The refrigerator 14 is a two-stage refrigerator and has a first cooling stage (not shown) and a second cooling stage 22. The second cooling stage 22 is surrounded by the pump chamber 12 and the heat shield 18 and is provided at the center of the interior space of the pump chamber 12 and the heat shield 18. The first cooling stage is cooled to the first cooling temperature level and the second cooling stage 22 is cooled to the second cooling temperature level lower than the first cooling temperature level. The second cooling stage is cooled to, for example, 10-20 K, and the first cooling stage is cooled to, for example, 80-100 K. The refrigerator 14 of the cryopump 10 according to a second embodiment, which will be described later with reference to FIG. 6, may be used in the cryopump 10 according to the first embodiment.

The heat shield 18 is thermally coupled to the first cooling stage of the refrigerator 14 and secured in that state. The heat shield 18 is cooled to a temperature substantially equal to the temperature of the first cooling stage. The heat shield 18 is provided as a radiation shield that protects the panel structure 16 and the second cooling stage 22 from the ambient radiant heat. Like the pump chamber 12, the heat shield 18 is also formed to have a cylindrical form having an opening at one end and having the other closed. The heat shield 18 is formed to have a cup-like shape. The pump chamber 12 and the heat shield 18 are both substantially cylindrically formed and are axially aligned. The internal diameter of the pump chamber 12 is slightly larger than the external diameter of the heat shield 18. A small interval between the heat shield 18 and the interior surface of the pump chamber 12 maintains the shield 18 and the chamber 12 in a noncontact state.

At the center of the interior space of the heat shield 18 is provided the second cooling stage 22 of the refrigerator 14. The refrigerator 14 is introduced via an opening in the lateral surface of the heat shield 18, and the first cooling stage is mounted in the opening. Thus, the second cooling stage of the refrigerator 14 is provided between the opening 20 and the bottom on the central axis of the heat shield 18.

The heat shield 18 may not be cylindrical in shape but may be a tube having a rectangular, elliptical, or any other cross section. Typically, the shape of the heat shield 18 is analogous to the shape of the interior surface of the pump chamber 12. The heat shield 18 may not be formed as a one-piece cylinder as illustrated. A plurality of parts may form a cylindrical shape as a whole. The plurality of parts may be provided so as to create a gap between the parts.

Baffles 23 are provided in the opening of the heat shield 18. According to this embodiment, the baffles 23 are louvers. The louvers 23 are provided at a distance from the panel structure 16 in the direction of central axis of the heat shield 18. The louvers 23 are mounted at the end of the heat shield 18 toward the opening and are cooled to a temperature substantially equal to the temperature of the heat shield 18. The louvers 23 may be formed to be concentric when viewed in the direction A. Alternatively, the louvers 23 may be provided to form, for example, a lattice. A gate valve (not shown) is provided between the louvers 23 and the vacuum chamber. The gate valve is closed when the cryopump 10 is regenerated and opened when the cryopump 10 is operated to evacuate the vacuum chamber.

The panel structure 16 is thermally coupled to the second cooling stage 22 of the refrigerator 14 and secured in that state. The panel structure 16 is cooled to a temperature substantially equal to the temperature of the second cooling stage 22. The panel structure 16 is provided with a plurality of cryopanels 24, a connecting member 26, and an intermediate member 28. The connecting member 26 is mounted on the second cooling stage 22 of the refrigerator 14, the intermediate member 28 is mounted on the connecting member 26, and the plurality of cryopanels 24 are mounted on the intermediate member 28. The cryopanels 24, the connecting member 26, and the intermediate member 28 are made of, for example, copper. A copper base plated with nickel may alternatively be used. Instead of copper, aluminum may be used to form the cryopanels 24. If heat conductivity is of concern, copper may be used. If reduction of weight and eventual reduction of regeneration time is of concern, aluminum may be used.

The connecting member 26 is used as a joint member that thermally couples the panel structure 16 to the second cooling stage 22 and mechanically supports the structure 16. The intermediate member 28 is used as a panel mounting member that thermally couples the plurality of cryopanels 24 to the second cooling stage 22 via the connecting member 26 and supports the cryopanels 24 as well. The connecting member 26 and the intermediate member 28 together may be regarded as a panel mounting member. The connecting member 26 and the intermediate member 28 may be formed as separate members or formed as one piece. The cryopanels 24 are thermally coupled to the second cooling stage 22 of the refrigerator 14 via the intermediate member 28 and the connecting member 26 and is cooled to a temperature substantially equal to the temperature of the second cooling stage 22. The intermediate member 28 and the connecting member 26 are similarly cooled to a temperature substantially equal to the temperature of the second cooling stage 22.

The panel structure 16 is suspended by the connecting member 26 to extend from the second cooling stage 22 of the refrigerator 14 downward, i.e., toward the bottom of the heat shield 18. The connecting member 26 is a suspending member that suspends the panel structure 16 from the refrigerator 14 and supports the structure 16 accordingly. In this way, the panel structure 16 is provided at a distance from the opening 20. As a result, radiation heat transferred to the panel structure 16 via the opening 20 is reduced. The arrangement also makes it possible to ensure a relatively large cryopanel area by utilizing the space between the panel structure 16 and the opening 20, thereby contributing to improvement in the pumping performance of the cryopanel.

The connecting member 26 suspends the intermediate member 28 from the cooling stage 22 and supports the member 28 accordingly. The intermediate member 28 is provided at a position farther from the opening 20 in the direction A than the second cooling stage 22. The intermediate member 28 supports the end of the plurality of cryopanels 24. The cryopanels 24 extend from the intermediate member 28 upward, i.e., toward the opening 20 of the heat shield 18.

Therefore, the heat transfer path from the second cooling stage 22 of the refrigerator 14 to the end of the cryopanels 24 meanders inside the heat shield 18. In other words, the heat transfer path from the refrigerator 14 to the end of the cryopanels 14 extends from the second cooling stage 22 to the bottom of the heat shield 18 and is folded to extend toward the opening 20 of the heat shield 18. The heat transfer path is folded in the intermediate member 28. By designing the panel structure 16 so that the path is folded, a large cryopanel area is secured. Consequently, the cryopump 10 can achieve high pumping performance.

An adsorbent carrier surface to carry an adsorbent for adsorbing a gas is formed at least in a portion of the cryopanel surface. In this embodiment, the entirety of both surfaces of the cryopanels 24 is formed as an adsorbent carrier surface. In this surface, an adsorbent 25 is adhesively attached to the entirety of both surfaces of the cryopanels 24 so that the entire surface represents an adsorbent area. For example, activated charcoal particles may be used as the adsorbent 25. The entire adsorbent carrier surface is exposed to the opening 20.

Each of the cryopanels 24 has a connecting part 32 at the end thereof connected to the intermediate member 28, an end part 34 closest to the opening 20, and an middle part 36 connecting the connecting part 32 to the end part 34. In this embodiment, the connecting part 32, the end part 34, and the middle part 36 are formed as a single plate. The connecting part 32, the end part 34, and the middle part 36 may be formed to be separate and connected to form a single cryopanel 24. The connecting part 32 of the cryopanel 24 is mounted in the intermediate member 28. For example, a flange is formed at the end of the connecting part 32 so that the flange is mounted in the intermediate member 28 by an appropriate fixing means such as bolts and nuts. The cryopanel 24 and the intermediate member 28 may be formed a single member.

Since the intermediate member 28 is located at a position farther from the opening 20 in the direction A than the second cooling stage 22, the connecting part 32 of the cryopanel 24 is similarly located at a position farther from the opening 20 than the second cooling stage 22. The cryopanel 24 extends from the connecting part 32 toward the opening 20. The end part 34 of the cryopanel 24 is located at a position closer to the opening 20 in the direction A than the second cooling stage 22 and the center of the heat shield 18. The middle part 36 of the cryopanel 24 is located at a position that generally coincides with the second cooling stage 22 and the center of the heat shield 18 in the direction A. The cryopanel 24 extends from the connecting part 32 to the end part 34 in the direction A beyond the center of the interior space of the heat shield 18.

In this embodiment, the heat shield 18 and the pump chamber 12 are substantially analogous. Therefore, the connecting part 32 of the cryopanel 24 is farther from the opening 20 in the direction A than the center of the pump chamber 12. The end part 34 of the cryopanel 24 is closer to the opening 20 in the direction A than the center of the pump chamber 12. By allowing the cryopanel 24 to extend beyond the center of the heat shield 18 or that of the pump chamber 12 in the direction A, it is ensured that the cryopanel provided to extend in the direction A has a large area. This allows the cryopump 10 to achieve high pumping performance.

The cryopanel 24 may be provided such that the end part 34 is located lower than the center of the heat shield 18 or that of the pump chamber 12 or toward the bottom of the shield 18 or the chamber 12. Similarly, the end part 34 of the cryopanel 24 may be located lower than the second cooling stage 22 of the refrigerator 14. In this case, the cryopanel 24 may be folded at the end part 34 and extend downward again in the cryopump. In other words, the cryopanel 24 may be formed such that the panel extends from the connecting part 32 to the end part 34 and is then folded at the end part 34 toward the lower part of the cryopump. In this way, a large panel area is secured while preventing the length of the cryopanel 24 from being increased excessively in the direction A. It will also make it possible to provide a compact panel structure 16 at the bottom of the pump in order to avoid radiation heat. The position and shape of the end part 34 of the cryopanel 24 may be determined in consideration of, for example, the required pumping performance of the cryopump 10 and the effects from radiation heat from outside.

The cryopanels 24 are provided in the interior of the heat shield 18 at a distance from the opening 20 or the louvers 23 and is exposed with respect to the opening 20 or the louvers 23. An upper space 38 is formed between the cryopanel 24 and the opening 20 or the louvers 23. No shielding members for shielding the cryopanels 24 are provided in the upper space 38 when the pump is viewed from outside. Therefore, the upper space 38 contributes to improvement in the flowability of gas introduced toward the cryopanels 24 from outside. Accordingly, the pumping speed per unit area of the cryopanels 24 is improved.

At least the connecting part 32 of the cryopanel 24 is exposed to the opening 20. In this embodiment, the end part 34 and the middle part 36 of the cryopanel 24 are exposed to the opening 20. As a result, the entirety of the cryopanel 24 is exposed to the opening 20. Accordingly, the entire surface of the cryopanels 24 can directly capture gas molecules introduced into the interior space of the heat shield 18 from outside. The entirety of the adsorbent carrier surface of the cryopanels 24 can directly capture gas molecules. Thus, unlike the structure in which the adsorbent 25 is shielded from the opening 20, gases can be efficiently processed. Since the entire surface of the cryopanel 24 is formed as an adsorbent area, a non-condensable gas such as hydrogen can be efficiently pumped. Such a panel structure is favorable for use in a cryopump for, for example, an ion implantation apparatus primarily configured to pump non-condensable gases.

The cryopanels 24 are provided so as to be parallel with the direction A. In this embodiment, the cryopanel 24 is provided to stand perpendicularly on the intermediate member 28. Thus, the cryopanels 24 are provided perpendicular to the opening 20. Since both surfaces of the cryopanels 24 can be equally used for pumping, gases can be efficiently pumped. The cryopanels 24 may be provided in a tilting position so as to intersect the direction A, considering the flowability of gas, radiant heat from outside, etc., in an comprehensive manner.

As shown in FIG. 2, the cryopanels 24 according to the embodiment are radially provided. The cryopanels 24 are provided equidistant from each other except where a space should be reserved for introduction of the refrigerator 14. For example, the cryopanels 24 are provided at equal angular intervals of, for example, 10 through 20 degrees. The cryopanel 24 is provided toward the circumference of the disk-shaped intermediate member 28. A cylindrical space surrounded by the panels is formed at the center of the intermediate member 28. The cryopanel 24 is configured to radially extend from the circumferential part of the intermediate member 28 to occupy approximately half of the radius of the member 28. In this case, a cylindrical space having a diameter approximately half the diameter of the intermediate member 28 is formed at the center of the member 28. As described, it is preferable to provide the panels toward the circumference of the surface of the intermediate member and to form an open space at the center, when the cryopanels 24 are radially provided on the surface of the intermediate member 28. In this way, the panels are prevented from being located excessively close to each at the center with the result that the flowability of gas is favorable.

A panel layout different from the above-described layout according to the embodiment may be employed. For example, the panels may not be radially provided. The panels may be provided parallel with each other or provided to form a lattice. The interval between the panels may be uniform or nonuniform. A cylindrical peripheral panel having the same diameter as the intermediate member 28 may be provided at the circumference of the member 28. In addition to the peripheral panel, a concentric cylindrical panel having a smaller diameter may also be provided.

As shown in FIG. 1, the cryopanel 24 has a trapezoidal shape with a progressively larger width away from the connecting part 32 and toward the end part 34. The lateral, circumferential edge of the cryopanel 24 is parallel with the direction A. The lateral, interior edge of the panel extends in a direction intersecting the direction A. The shape of the cryopanel 24 may not be trapezoidal as shown in FIG. 1. The panel may have a rectangular or other shape. The cryopanels 24 may have mutually different shapes. For example, cryopanels of a plurality of shapes may coexist. For example, large cryopanels and small cryopanels may coexist.

The intermediate member 28 is a plate member having, for example, a disk shape. The top surface of the intermediate member 28, i.e., the surface facing the opening 20 represents a panel mounting surface. The panel mounting surface is a flat, circular surface. The intermediate member 28 may not be a plate member having a disk shape but a plate member having another shape. Alternatively, the intermediate member 28 may be curved or flexed. For example, the member 28 may be shaped like a dome that rises closer to the opening 20 toward the center of the member. In this case, the curved surface of the dome represents a panel mounting surface.

A panel mounting surface may also be formed on the underside of the intermediate member 28 so as to mount a plurality of cryopanels 24. In this case, slits may be formed in the intermediate member 28 to promote the flow of gas between adjacent panels. With this configuration, the flow of gas to the panels provided to project toward the bottom of the cryopump is promoted.

The connecting member 26 is formed to, for example, surround the second cooling stage 22. One end of the connecting member 26 facing the opening 20 is provided with a refrigerator mounting part mounted in the second cooling stage 22 of the refrigerator. A flange mounted in the intermediate member 28 is formed at the other end facing the bottom of the pump. A suspending part extends from the periphery of the refrigerator mounting part downward in the pump. The flange is formed at the end of the suspending part. The flange of the connecting member 26 is mounted in the intermediate member 28 by an appropriate fixing means such as bolts and nuts.

The connecting member 26 and the cryopanel 24 are connected in an indirect manner via the intermediate member 26. However, a heat transfer path directly coupled to the connecting member 26 may be provided at the end part 34 of the cryopanel 24 in order to improve thermal conductivity to the end part 34 of the cryopanel 24. The heat transfer path is preferably formed to ensure that the flowability of gas is least affected. For example, it is desirable to form the path by a plane provided parallel with the direction A.

As described above, the cryopanels 24 according to this embodiment are arranged in a radial and equidistant layout. The intermediate member 28 provided as a panel mounting member and having a panel mounting surface is arranged such that the geometric factor occurring when a heat source is viewed from the panel mounting surface is minimized. For example, the panel mounting surface is a circular plane provided to face the opening 20 of the cryopump 10 and to be parallel therewith. The position of the intermediate member 28 in the direction A is configured such that the geometric factor occurring when a heat source is viewed from the panel mounting surface is minimized. By determining the position of the panel mounting surface such that the geometric factor is minimized, input of radiant heat from outside to the panel mounting surface is minimized. Accordingly, radiant heat transferred to the panel structure 16 is reduced.

Generally, the radiant heat Q between two planes A1 and A2 is given by the following expression, using a geometric factor $\phi_{12}$ occurring when plane A2 is viewed from plane A1.

$$Q=\epsilon\sigma(T_1^4-T_2^4)A1\phi_{12}$$

where $\epsilon$ denotes emissivity (i.e., absorptivity), $\sigma$ denotes the Stephan-Boltzman constant, T1 and T2 denote the temperature of plane A1 and plane A2, respectively, and A1 denotes the area of plane A1.

In other words, the radiant heat Q depends on the geometric factor $\phi_{12}$. The larger the geometric factor $\phi_{12}$, the larger the radiant heat Q.

The radiant heat Q is proportional to the emissivity $\epsilon$. The emissivity $\epsilon$ is such that $\epsilon=1$ in the case of a full radiator. If the copper surface is plated with nickel, the emissivity $\epsilon$ is 0.027 when the surface temperature is 20 K, for example. In contrast, the emissivity $\epsilon$ of activated charcoal is extremely large as compared to the metallic panel surface, since activated charcoal is considered as a full radiator. Even if a material other than activated charcoal is used as an adsorbent, the emissivity $\epsilon$ will be considerably larger than that of the metallic surface. Therefore, if the adsorbent is exposed to the opening of the cryopump, a relatively large amount of radiant heat is transferred to the cryopanel via the adsorbent.

The geometric factor $\phi_{12}$ is generally given by the following expression.

$$\phi_{12}=\frac{1}{A_1}\int_{A_1}\int_{A_2}\frac{\cos\beta_1\beta_2}{\pi l^2}dA_2dA_1$$

where $A_i$ (i=1, 2) denotes the area of plane $A_i$, 1 denotes the distance between $dA_1$ and $dA_2$, and $\beta_i$ denotes the angle formed by the direction normal to $dA_i$ (i=1, 2) and 1.

Thus, assuming a micro heat source lying on the central axis of the cryopump 10 and facing the panel mounting surface, the geometric factor is given by defining the orientation of the panel mounting surface, the area of the panel mounting surface, and the position of the panel mounting surface on the central axis of the cryopump 10. If the panel mounting surface is a circular plane provided to face the opening 20 of the cryopump 10 and to be parallel therewith, the geometric-factor is reduced by reducing the diameter of the panel mounting surface and by placing the panel mounting surface close to the pump bottom along the central axis of the cryopump 10 (i.e., in the direction A). Since the distance 1 is considered to be the largest factor that affects the geometric factor, the geometric factor may be minimized using only the position of the panel mounting surface along the central axis of the pump as a parameter.

It would be appreciated that the panel mounting surface may be formed at a position corresponding to the end (i.e., the connecting part 32) of the cryopanel 24 toward the lower part of the pump in order to minimize the geometric factor of the panel mounting surface in the radial cryopanel layout according to the embodiment. This is because such an arrangement will maximize the distance between an external heat source and the panel mounting surface.

Thus, according to the embodiment, the cryopanel layout that achieves desired pumping performance is supported by a panel mounting surface having a minimized geometric factor. Accordingly, the objectives of achieving required pumping performance and reducing the input of radiant heat are both fulfilled.

If the panel mounting surface and the panel mounting member are close to the bottom or the lateral part of the heat shield 18, the arrangement and shape of the panel mounting surface may be designed in further consideration of radiant heat from the heat shield 18.

Before operating the cryopump 10 as described above, a roughing pump other than the pump 10 is used for rough pumping to evacuate the vacuum chamber of an ion implantation apparatus the volume of which is subject to pumping to a level of about 1 Pa. The cryopump 10 is then operated. The first cooling stage and the second cooling stage 22 are cooled by driving the refrigerator 14. The heat shield 18, the louvers 23, and the panel structure 16 are cooled to the cooling temperature level of the cooling stage to which they are connected. The cryopanel 24 is cooled by the second cooling stage 22 via the meandering heat transfer path including the connecting member 26 and the intermediate member 28.

The louvers 23 thus cooled cools gas molecules traveling from the volume subject to pumping to the interior of the cryopump 10, condenses a gas (e.g., moisture) having a vapor pressure sufficiently lower than an ambient pressure at that cooling temperature on its surface, and pumps the gas accordingly. Gases having a vapor pressure not sufficiently lower than an ambient pressure at the cooling temperature of the louvers 23 travel past the louvers 23 and are introduced into the interior of the heat shield 18. Of the gases thus introduced, the gas (e.g., argon) having a vapor pressure sufficiently lower than an ambient pressure at the cooling temperature of the panel structure 16 is condensed on the surface of the panel structure 16 and is pumped accordingly. The gas (e.g., hydrogen) having a vapor pressure not sufficiently lower than an ambient pressure at that cooling temperature is adsorbed by the adsorbent on the surface of the panel structure 16 and is pumped accordingly.

In the case of the vacuum chamber of an ion implantation apparatus, hydrogen is predominant in the gases to be pumped. The end part 34 of the cryopanel 24 is exposed to the opening of the cryopump. The hydrogen gas is efficiently adsorbed by the adsorbent 25 provided in the end part 34 and is pumped accordingly. Since the middle part 36 and the connecting part 32 of the cryopanel 24 are exposed to the opening of the cryopump, the gas introduced is efficiently pumped in these portions. In this way, the cryopump 10 is capable of bringing the degree of vacuum in the vacuum chamber to a desired level.

A description will now be given of how pumping efficiency is improved and regeneration time is reduced in accordance with the embodiment by making a comparison with a cryopump 100 shown in FIG. 3. The cryopump 100 shown in FIG. 3 has the same structure as that of the cryopump 10 shown in FIG. 1 except for the structure of a panel structure 116. The cryopump 100 is provided with a pump chamber 112, a refrigerator 114, a panel structure 116, and a heat shield 118. The cryopump 100 is of horizontal type. The refrigerator 114 is introduced in a direction perpendicular to the central axis of the heat shield 118. The second cooling stage 122 of the refrigerator 114 is located at the center of the heat shield 118. Louvers 123 are provided in an opening 120 (inlet port) of the heat shield 118.

The panel structure 116 is provided with cryopanels 130, a panel mounting member 132, and a refrigerator mounting member 134. The end of each of the cryopanels 130 toward the opening 120 is mounted on the underside of the panel mounting member 132 and extends downward in the pump. The panel mounting member 132 is a disc member provided parallel with the opening 120 between the second cooling stage 122 of the refrigerator 114 and the louvers 123. The panel mounting member 132 is a radiation shield configured to reduce radiant heat transferred to the cryopanels 130 from outside. The refrigerator mounting member 134 connects the center of the underside of the panel mounting member 132 to the second cooling stage 122. The cryopanel 130 is thermally coupled to the second cooling stage 122 of the refrigerator 144 via the panel mounting member 132 and the refrigerator mounting member 134. For example, the cryopanel 130 is a trapezoidal plate with a progressively larger width toward the lower part of the pump. An adsorbent carrier surface is formed on the entirety of both surfaces of the cryopanel 130 and an adsorbent 125 (e.g., activated charcoal) is attached to the adsorbent carrier surface.

Figure 4:
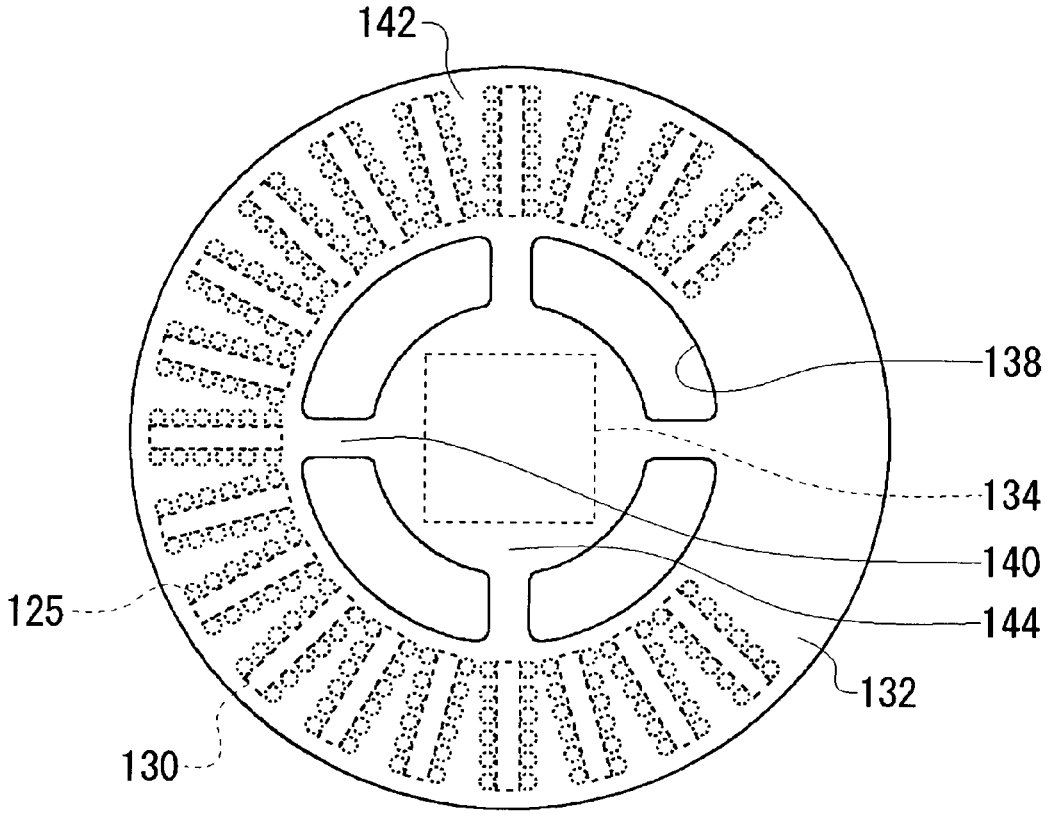
FIG. 4 schematically shows a part of the cryopump according to the comparative example.

FIG. 4 shows the panel mounting member 132 viewed from the opening 120. Referring to FIG. 4, the cryopanels 130 and the refrigerator mounting member 134 mounted on the underside of the panel mounting member 132 are indicated by broken lines. The cryopanels 130 are radially provided at equal angular intervals of, for example, 15°. In order to secure a space for mounting the refrigerator 114, the cryopanel 130 is not provided in a portion (toward right in FIG. 4) of the underside of the panel mounting member 132. Therefore, a total of, for example, 19 cryopanels 130 are closely arranged on the panel mounting member 132.

Through holes 138 are formed in the panel mounting member 132. The through holes 138 are provided to improve the flowability of gas from the opening 120 to the cryopanels 130. A total of, for example, four through holes 138 are provided in a circumferential direction of the panel mounting member 132 between the cryopanels 130 and the refrigerator mounting member 134. The through holes 138 opens the major portion of the panel mounting member 132 between a circumferential part 142 in which the cryopanels 130 are mounted and a central part 144 in which the refrigerator mounting member 134 is mounted. The circumferential part 142 and the central part 144 are connected by connecting parts 140. The connecting parts 140 are formed to be straight. For example, four connecting parts 140 are radially formed at equal intervals of, for example, 90 degrees. The panel mounting member 132 may be provided with slits between two adjacent cryopanels 130 in order to improve the flowability of gas.

By ensuring that the part of the panel mounting member 132 between the circumferential part 142 and the central part 144 is open, the flowability of gas is improved so that gas molecules are likely to arrive at the center of the panel structure 116. As a result, favorable pumping performance is achieved. More specifically, favorable pumping speed and amount of occlusion are achieved, for example.

Figure 3:
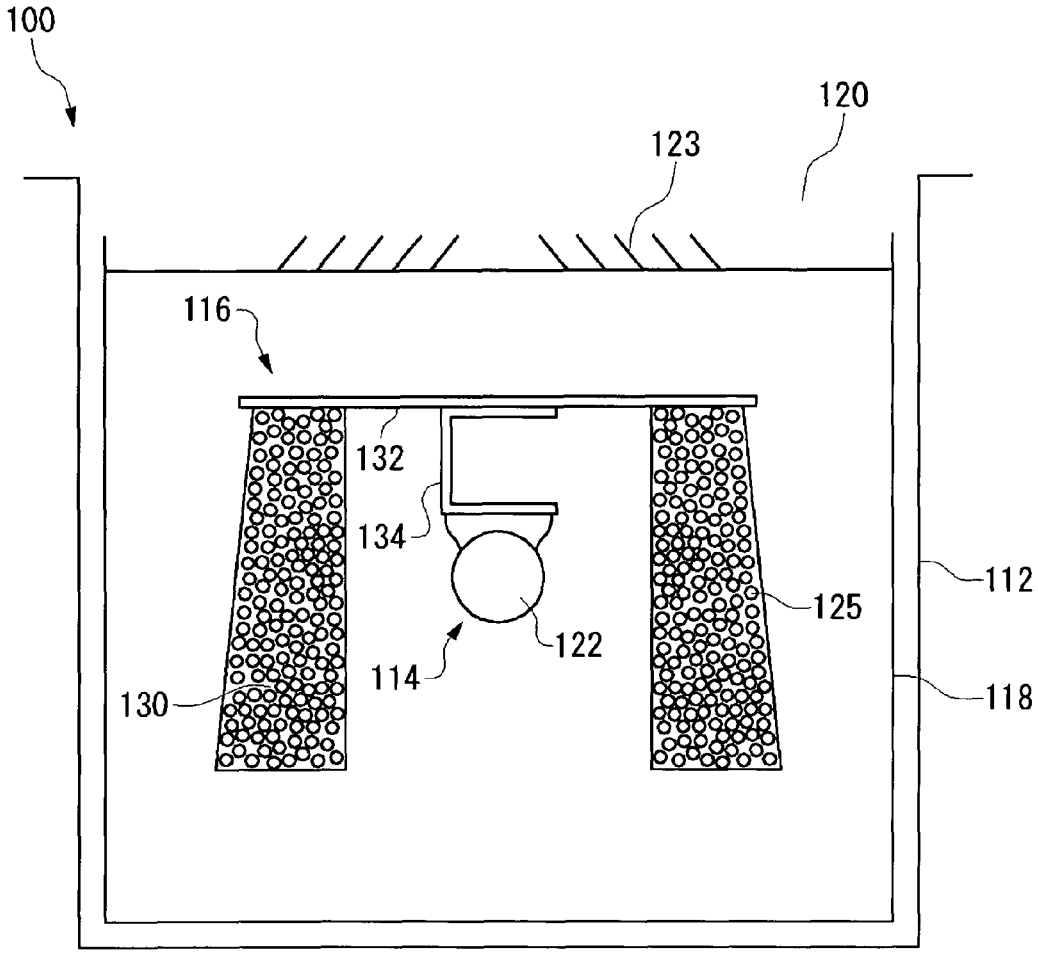
FIG. 3 schematically shows a part of a cryopump according to a comparative example.

According to the first embodiment of the present invention, the same pumping speed as achieved by the cryopump 100 of a star-burst arrangement shown in FIG. 3 can be achieved with a smaller panel area. For example, the cryopump 100 of a star-burst arrangement can achieve a hydrogen gas pumping speed of 11000-12000 L/s. A comparison will be made with the suspended cryopanel pump 10 according to the embodiment in which is employed a radial panel layout including a total of 19 panels as in the case of the cryopump 100 of a star-burst arrangement. Experiments have verified that, even if the panel length is reduced by 20% and the activated charcoal carrier pasted area is reduced by 24% relative to the cryopump 100 of a star-burst arrangement, the suspended cryopump 100 can achieve the hydrogen gas pumping speed of 11000-12000 L/s similarly to the pump 100.

Thus, according to the embodiment, the pumping speed per unit area of the activated charcoal area is remarkably improved and high pumping efficiency is achieved. Since a desired pumping speed is achieved with a more compact panel structure 16, the panel structure 16 may be provided toward the bottom of the cryopump 10, securing a large distance from the opening 20. This also reduces radiant heat transferred to the cryopanels 24 from outside.

The total weight of the cryopanels 24 of the suspended cryopump 10 is reduced by 20% compared with that of the cryopump 100 of a star-burst arrangement. Consequently, the time required in a regeneration process for re-cooling the cryopanels 24 and the activated charcoal on its surface is reduced. Experiments have verified that the regeneration time required to pump a hydrogen gas by adsorption using the cryopump 100 of a star-burst arrangement is 168 minutes, for example. In contrast, the regeneration time required to pump the same amount of hydrogen gas using the suspended cryopump 10 is 132 minutes, for example. Reduction of 26 minutes is due to reduction in the time required for re-cooling.

As described, according to the embodiment, an extremely practical cryopump is provided by employing a novel concept of suspension. An immediate benefit is that the cryopanels are ensured to be less affected by radiant heat and high pumping performance is achieved at the same time. Further, pumping performance that serves practical needs can be achieved by a compact cryopanel structure. Further, regeneration time is considerably reduced.

Figure 5:
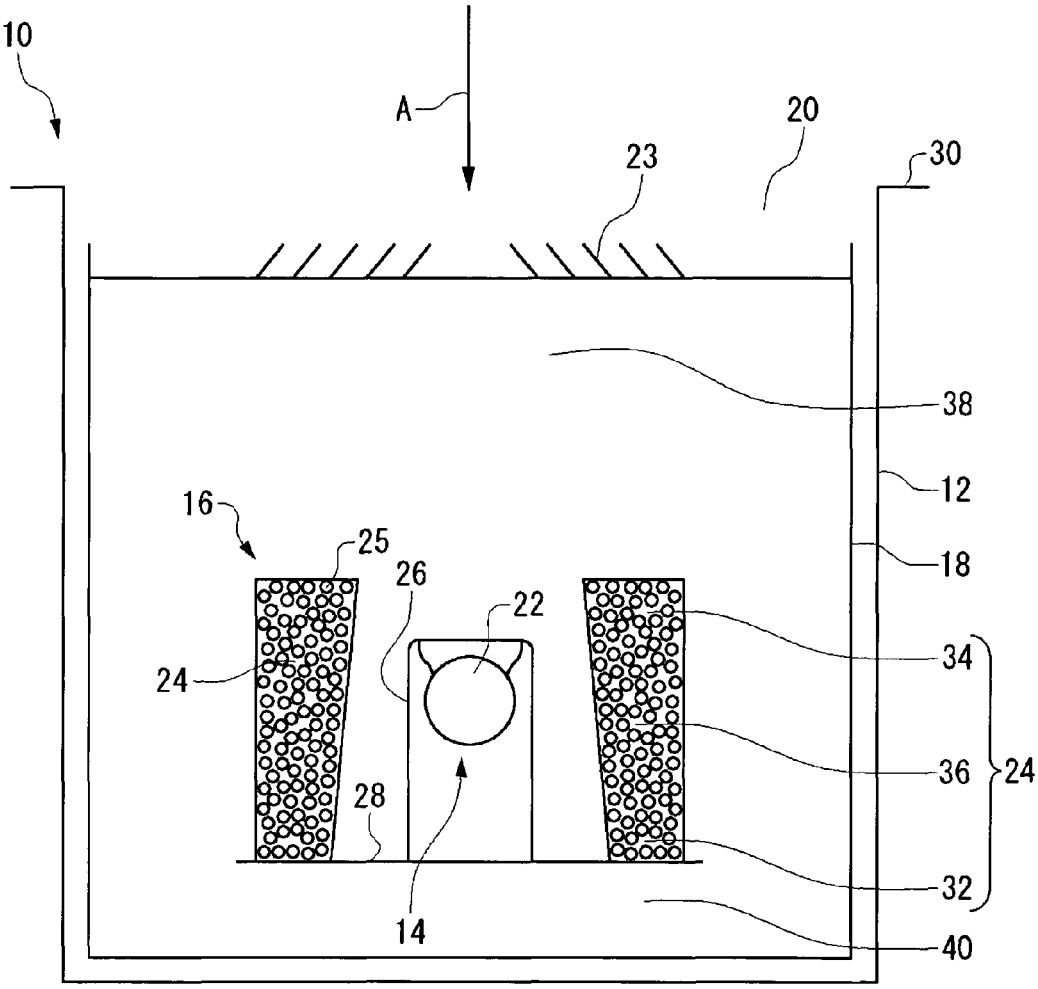
FIG. 5 shows a variation of the first embodiment.

FIG. 5 shows a variation of the first embodiment. In the cryopump 10 according to the first embodiment, the interval between the opening 20 and the end part 34 of the cryopanel 24 is substantially identical to the interval between the bottom of the heat shield 18 and the lowermost part of the panel structure (i.e., the intermediate member 28). The extent of the space above the panel structure 16 and that of the space below in the direction of central axis are identical. However, the upper space 38 above the panel structure 16 may be larger or smaller than the space below the panel structure 16.

For example, as shown in FIG. 5, the panel structure 16 may be provided such that its barycentric position is located below the center of the interior space of the cryopump. In this case, the upper space 38 above the panel structure 16 is larger than a lower space 40 below the panel structure 16. More specifically, the interval between the opening 20 and the end part 34 of the cryopanel 24 is larger than the interval between the bottom of the pump chamber 12 or the heat shield 18 and the connecting part 32 of the cryopanel 24. The barycentric position of each cryopanel 24 is farther from the opening 20 in the direction A than the center of the interior space of the pump or the second cooling stage 22 of the refrigerator 14. By securing a large upper space 38, it is ensured that the panel structure 16 is less affected by radiant heat from outside.

By providing the panel structure 16 toward the bottom of the pump, the length of the cryopanel in the direction A can be extended. Accordingly, a large cryopanel area can be secured. As a result, pumping performance is improved.

A description will now be given, with reference to FIG. 6, of the cryopump 10 according to a second embodiment of the present invention. The cryopump 10 according to the second embodiment is different from that of the first embodiment in respect of the relative position of the refrigerator 14 and the cryopanels 24. In the first embodiment, the cryopanels 24 extend from near the bottom of the pump toward the opening 20 beyond the second cooling stage 22. In contrast, the cryopanels 24 according to the second embodiment are provided nearer the opening 20 than the refrigerator 14. In the second embodiment, the refrigerator 14 is mounted at a position near the bottom of the pump in order to lower the barycentric position of the panel structure 16.

In the following description, the same description already given in the first embodiment will be omitted for brevity. The first embodiment and variations thereof described in association therewith may be used in combination with the second embodiment and variations thereof described in association therewith.

Figure 6:
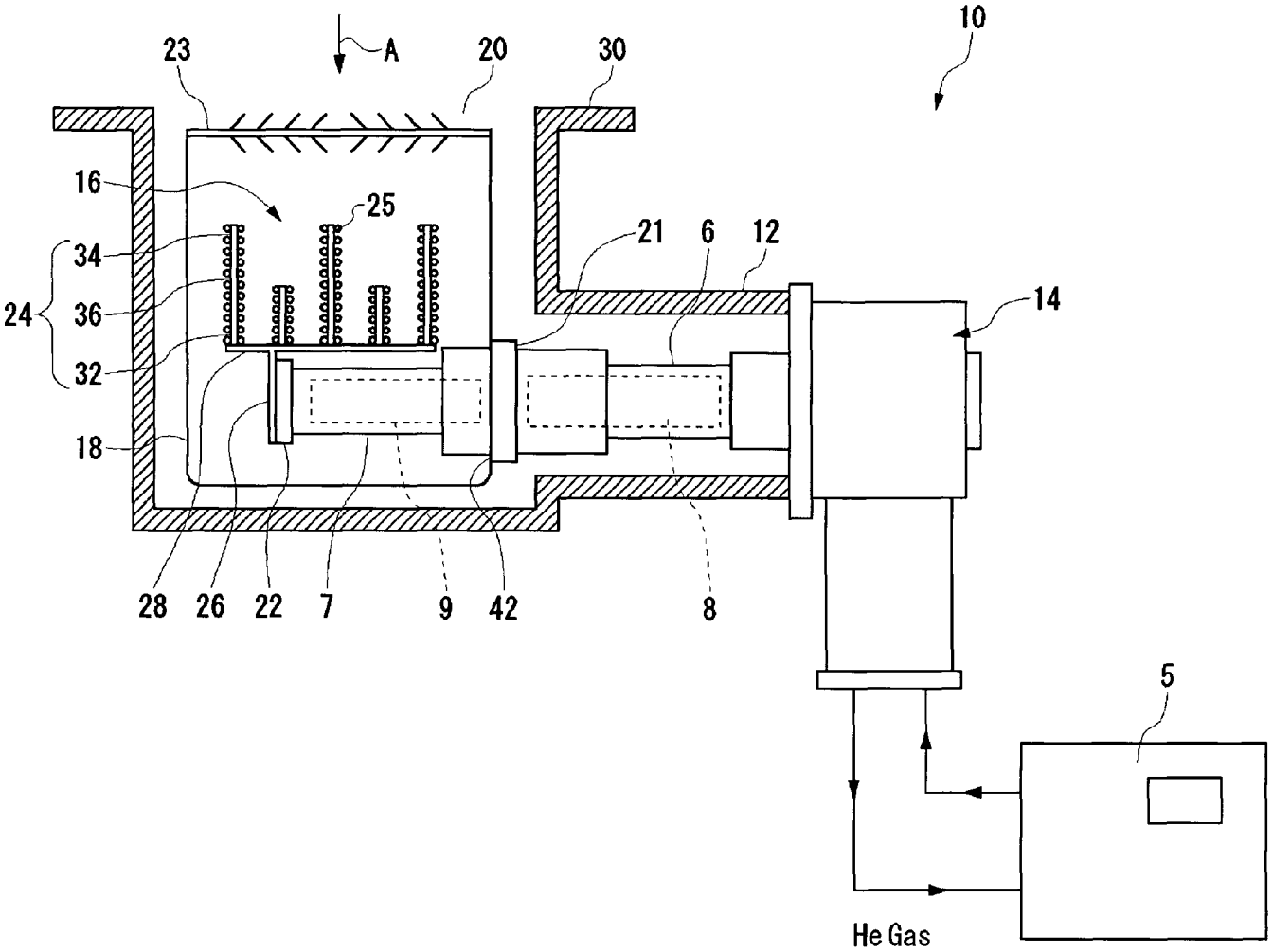
FIG. 6 schematically shows the cross section of a cryopump according to a second embodiment of the present invention.

FIG. 6 schematically shows the cross section of the cryopump 10 according to the second embodiment. Like the cryopump according to the first embodiment, the cryopump 10 as illustrated is of horizontal type.

As shown in FIG. 6, the refrigerator 14 includes a first stage cylinder 6, a second stage cylinder 7, and a motor (not shown). The first stage cylinder 6 and the second stage cylinder 7 are connected in series. The first stage cylinder 6 accommodates a first stage displacer 8 and the second stage cylinder 7 accommodates a second stage displacer 9. The displacer 8 and the displacer 9 are connected to each other. By driving the first stage displacer 8 and the second stage displayer 9 by a motor to make a reciprocal movement inside the first stage cylinder 6 and the second stage cylinder 7, respectively, adiabatic expansion of a coolant such as helium gas circulating inside is caused, thereby producing refrigeration. A compressor 5 raises the pressure of the coolant gas for the refrigerator 14 and delivers the gas to the refrigerator 14. The compressor 5 collects the coolant gas subjected to adiabatic expansion in the refrigerator 14 and raises its pressure again.

A first cooling stage 21 is provided at the end of the first stage cylinder 6 facing the second stage cylinder 7. A second cooling stage 22 is provided at the end of the second stage cylinder 7. The first cooling stage 21 and the second cooling stage 22 are secured to the first stage cylinder 6 and the second stage cylinder 7, respectively, by, for example, brazing.

Baffles 23 are provided in the opening 20 of the heat shield 18 formed to have a cup-like shape. The baffles 23 are in Chevron formation. The pump chamber 12 is formed so as to hermetically accommodate the heat shield, the first stage cylinder 6 and the second stage cylinder 7 of the refrigerator 14.

A refrigerator mounting hole 42 is formed in the side of the heat shield 18 toward the bottom of the pump. More specifically, the refrigerator mounting hole 42 is formed in the side of the heat shield 18 close to the bottom of the pump. The second stage cylinder 7 and the second cooling stage 22 of the refrigerator 14 are introduced through the refrigerator mounting hole 42 in a direction perpendicular to the direction of central axis of the heat shield 18. The heat shield 18 is thermally coupled to the first cooling stage 21 via the refrigerator mounting hole 42 and secured in that state. Thus, in the second embodiment, the second cooling stage 22 of the refrigerator 14 is provided at a position farther from the opening 20 than the center of the heat shield 18 in the direction A. Accordingly, the second cooling stage 22 is provided at a position farther from the opening 20 than the center of the pump chamber 12 in the direction A. Further, the second cooling stage 22 is provided in the space inside the pump farther from the opening 20 than the connecting part 32 of the cryopanel 24.

The panel structure 16 is thermally coupled to the second cooling stage 22 and secured in that state. The connecting member 26 is mounted in the second cooling stage 22, the intermediate member 28 is mounted in the connecting member 26, and the cryopanels 24 are provided to stand on the intermediate member 28. For example, the intermediate member 28 is a rectangular plate member. The cryopanels 24 are provided to stand vertically on the surface of the intermediate member 28 facing the opening 20. An adsorbent carrier surface is formed on the entirety of both surfaces of the cryopanel 24 and an adsorbent 25 (e.g., activated charcoal) is attached to the adsorbent carrier surface.

For example, the cryopanel 24 is a rectangular plate member. Cryopanels of two different lengths in the direction A are alternately provided. By using cryopanels with a greater length in the direction A and cryopanels with a smaller length in combination, the density of adsorption area per unit volume in the pump's interior space is adjusted in accordance with the distance from the opening 20. As illustrated, the cryopanels 24 are relatively sparse in the neighborhood of the opening 20. The cryopanels 24 are relatively densely arranged in the neighborhood of the intermediate member 28 and away from the opening 20. This ensures that the flowability of gas in the neighborhood of the opening 20 is favorable. The dense arrangement of panels in the neighborhood of the intermediate member 28 secures a large panel area.

In the second embodiment, the connecting member 26, the intermediate member 28, the cryopanels 24 are arranged in the stated order from near the bottom of the pump toward the opening 20. The connecting part 32 of the cryopanel 24 is provided at a position farther from the opening 20 than the center of the pump chamber 12 or the heat shield 18. The cryopanels 24 extend to reach a position closer to the opening 20 than the center of the pump chamber 12 or the heat shield 18. The second embodiment equally allows the panel structure 16 to be provided in a relatively lower part of the interior space of the pump so that the structure is less affected by radiant heat from outside. Since a space is secured above the panel structure 16, the flowability of gas is improved and the pumping performance is improved. The cryopanels 24 having a relatively large area can be provided using the space above the panel structure 16.

What is claimed is:

1. A cryopump apparatus, comprising:

a heat shield container defining a heat shield chamber and having an opening into the heat shield chamber and a heat shield container bottom portion facing the opening and disposed apart therefrom in a height-wise direction;

a louver unit connected to the heat shield container and extending across the opening in a width-wise direction being perpendicular to the height-wise direction;

a cryopump cabinet defining a cryopump chamber and having an inlet port into the cryopump chamber and a cryopump cabinet bottom portion facing the inlet port, the inlet port sized to receive the heat shield container and the louver unit connected thereto, the louver unit disposed adjacent to and extending substantially across the inlet port, the heat shield container bottom portion and the cryopump cabinet bottom portion being disposed apart from yet adjacent to one another;

a cryogenic refrigerator; and a cryopanel structure disposed in the heat shield chamber between the louver unit and the heat shield container bottom portion, the cryopanel structure including:

a plurality of cryopanel members, each one of the plurality of cryopanel members being a flat plate having a flat plate height terminating at opposing flat plate edges and a flat plate width; and an intermediate member interconnecting a portion of the cryogenic refrigerator and the plurality of the cryopanel members disposed in the heat shield chamber, the intermediate member fabricated from a thermally conductive material for facilitating thermal communication between the portion of the cryogenic refrigerator and the plurality of the cryopanel members, wherein each one of the plurality of cryopanel members is connected to the intermediate member at one of the flat plate edges to project upwardly from the intermediate member towards the louver unit, wherein each one of the plurality of cryopanel members is trapezoidal shaped as viewed in elevation with one of the flat plate edges having a first width and a remaining one of the flat plate edges having a second width being smaller than the first width, each one of the plurality of cryopanel members being connected to the intermediate member along the flat plate edge having the second width.

2. The cryopump apparatus according to claim 1, wherein each one of the plurality of cryopanel members is coated with an adsorbent material.

3. The cryopump apparatus according to claim 1, wherein the cryogenic refrigerator includes a cooling stage and a connecting member interconnecting the cooling stage and the intermediate member, the connecting member fabricated from a thermally conductive material.

4. The cryopump apparatus according to claim 1, wherein the immediate member is a flat plate disposed between and extending parallel to the louver unit.

5. The cryopump apparatus according to claim 4, wherein the immediate member is disk-shaped and has an a central part extending from and about a central point, an inner peripheral part integrally connected to and surrounding the central part and an outer peripheral part integrally connected to and surrounding the inner peripheral part, the inner peripheral part including a plurality of holes extending therethrough.

6. The cryopump apparatus according to claim 5, wherein the outer peripheral part is connected to respective ones of the plurality of cryopanel members and respective individual ones of the plurality of cryopanel members are aligned along respective radial axes extending from the center point of the central part.

7. The cryopump apparatus according to claim 1, wherein the flat plate width is smaller than the flat plate height.

8. The cryopump apparatus according to claim 1, further comprising at least one additional cryopanel having a configuration of a cylindrical-shaped plate.

9. A cryopump apparatus, comprising:

a heat shield container defining a heat shield chamber and having an opening into the heat shield chamber and a heat shield container bottom portion facing the opening and disposed apart therefrom in a height-wise direction;

an inlet cryopanel connected to the heat shield container and extending across the opening in a width-wise direction being perpendicular to the height-wise direction;

a cryopump cabinet defining a cryopump chamber and having an inlet port into the cryopump chamber and a cryopump cabinet bottom portion facing the inlet port, the inlet port sized to receive the heat shield container and the inlet cryopanel connected thereto, the inlet cryopanel disposed adjacent to and extending substantially across the inlet port, the heat shield container bottom portion and the cryopump cabinet bottom portion being disposed apart from yet adjacent to one another;

a cryogenic refrigerator; and a cryopanel structure disposed in the heat shield chamber between the inlet cryopanel and the heat shield container bottom portion, the cryopanel structure including:

a plurality of cryopanel members, each one of the plurality of cryopanel members being a flat plate having a flat plate height terminating at opposing flat plate edges and a flat plate width; and an intermediate member interconnecting a portion of the cryogenic refrigerator and the plurality of the cryopanel members disposed in the heat shield chamber, the intermediate member fabricated from a thermally conductive material for facilitating thermal communication between the portion of the cryogenic refrigerator and the plurality of the cryopanel members, wherein, each one of the plurality of cryopanel members is oriented in the heat shield chamber in a manner that the flat plate height extends between the inlet cryopanel and the heat shield container bottom portion in the height-wise direction and the flat plate width extends in the width-wise direction, wherein each one of the plurality of cryopanel members is trapezoidal shaped as viewed in elevation with one of the flat plate edges having a first width and a remaining one of the flat plate edges having a second width being smaller than the first width, each one of the plurality of cryopanel members being connected to the intermediate member along the flat plate edge having the second width.

* * * * *